United States Patent [19]

Naramore

[11] 4,132,400

[45] Jan. 2, 1979

[54] APPARATUS FOR ALIGNING A STACK OF SHEETS

[75] Inventor: Raymond Naramore, Penfield, N.Y.

[73] Assignee: Xerox Corporation, Stamford, Conn.

[21] Appl. No.: 811,405

[22] Filed: Jun. 29, 1977

[51] Int. Cl.[2] ..... B65H 31/40

[52] U.S. Cl. ..... 271/221; 34/151; 214/6 S; 271/211

[58] Field of Search ..... 271/211, 221, 222, 210, 271/195, 236, 238, 97, 98; 214/6 S, 1 BE; 34/38, 149, 151, 163

[56] References Cited

U.S. PATENT DOCUMENTS

| | | | |
|---|---|---|---|
| Re. 16,779 | 11/1927 | Maxner | 271/211 |
| 1,743,921 | 1/1930 | Kerley | 271/211 |
| 3,563,360 | 2/1971 | Wickersheim | 271/221 X |
| 3,737,051 | 6/1973 | Horino | 214/6 S |

*Primary Examiner*—Bruce H. Stoner, Jr.

[57] ABSTRACT

Air forced through holes in a horizontally disposed platform is used to support a disoriented stack of rectangular sheets on a thin layer of air. The platform supports L-shaped manifolds disposed to be located about a supported stack of sheets. Each of the manifolds includes a chamber coupled to a fluid source and nozzle arrays communicating with the chambers to provide jets of air directed so as to impinge the edges of a stack of sheets pneumatically supported by the platform. The nozzles of each array are pyramidically disposed to provide an inverse relationship between jets impinging on a sheet of a stack and its distance above the platform. The jets provide air lubrication between adjacent sheets of the stack. Two of the manifolds are translatable and may be moved against the stack to tamp and align the air lubricated sheets thereof.

2 Claims, 3 Drawing Figures

APPARATUS FOR ALIGNING A STACK OF SHEETS

The subject invention relates to apparatus for tamping or jogging stacks of sheets to align edges thereof.

As is well known, a common method of aligning one or more edges of stacked sheets of paper or the like comprises picking up the stack and tapping edges thereof against a flat surface. In this method it is essential that sheets of the stack be relatively free to move with respect to each other and it will be appreciated that when thick stacks are handled with this method it is difficult for an operator to provide the pressures needed to support the stack while permitting relative mobility between the sheets to be aligned. To obviate this problem and to allow alignment of stacked sheets at commercial rates mechanical joggers have been developed. Such joggers generally include a bin into which stacks are inserted and means for vibrating the bins. In operation, the vibration of the bins cooperates with the action of gravity on the sheets of the stack to bring the sheets into alignment along a bottom surface of the bin and, possibly, a side surface of the bin. However, it should be noted that when sheets having a common size are to be aligned, alignment of two edges with bin surfaces does not means that alignment of all edges will result because flexible or flimsy sheets tend to slump or curl, as a result of which misalignment of at least one edge can occur. From the foregoing, it will be appreciated that when alignment of all edges of flexible sheets of the same sizes is required the sheets should be substantially parallel with respect to each other and, generally, this is accomplished by placing the sheets on a platform which is inclined so as to have at least a horizontal directional component. This, however, creates difficulty because inclination of the platform increases frictional forces between sheets of a stack and these forces are counter productive to the alignment process. To avoid some of the problems discussed above, attempts have been made to align sheets as a stack thereof is being formed. For example, U.S. Pat. No. 1,107,859, issued to B. D. Stevens, shows apparatus wherein sheets are serially fed towards a horizontal platform and as each sheet is fed it is caused to register against orthogonally related walls by jets of air. Unfortunately, the apparatus is only efficient when used on line with the source of sheets to be stacked.

It is an object of the present invention to provide improved apparatus for aligning the edges of a stack of sheets.

It is another object of the present invention to provide apparatus for aligning the edges of a stack of sheets, including means for minimizing sheet to sheet frictional forces during alignment.

Structurally, the invention may be implemented with: (a) a perforated platform for supporting a stack of sheets; (b) means for driving fluid through the perforated platform, thereby providing a fluid layer between the platform and a stack of sheets on the platform; (c) means for injecting fluid between sheets of a stack resting on the platform; and (d) means for tamping sheets of a stack resting on the platform, whereby when the stack of sheets is resting on the fluid layer and fluid is injected between the sheets, tamping of the stack aligns its component sheets.

A feature of the invention resides in that large stacks of flimsy sheets, such as 20 lb. paper, may be readily aligned.

Additional objects and features of the invention will become apparent by reference to the following description in conjunction with the accompanying drawings, in which.

Figure 1:
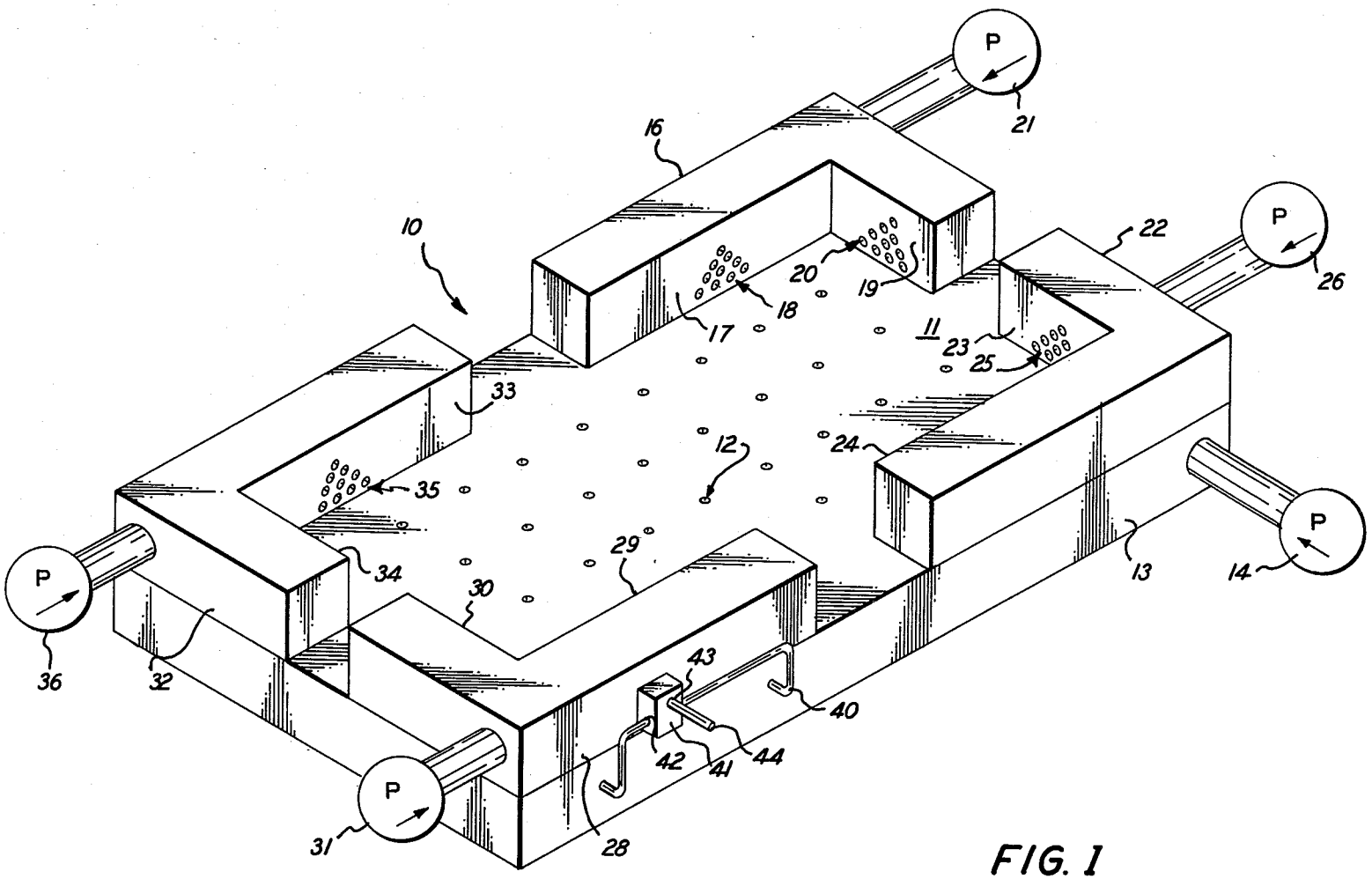
FIG. 1 is a perspective view of apparatus for aligning stacks of sheets, according to the invention.

Referring to FIG. 1, apparatus 10 assembled according to the invention includes a rectangular box 13 having a chamber. A horizontally disposed upper wall 11 of the box includes an array of vertically extending holes 12 which communicate with the chamber to define a perforated platform and a pump 14 coupled to the box injects fluid into the chamber to force fluid out of the box through the holes. Fluid jets emanating from the holes are intended to provide a fluid layer between the wall 11 and a stack of sheets 50 (see FIG. 2) to be aligned and, as is well known, the fluid layer functions as a lubricant which allows translation of the stack along said wall or perforated platform.

A corner section of wall 11 rigidly supports an L-shaped manifold 16 having a chamber and orthogonally related walls 17 and 19 extending perpendicularly with regard to wall 11. Wall 17 includes a pyramidal array of holes 18 which communicate with the chamber and wall 19 includes a pyramidal array of holes 20 which communicate with the chamber. The chamber of manifold 16 is coupled to a fluid pump 21 and the holes of arrays 18 and 20 extend, respectively, in directions normal to walls 17 and 19 to provide jets of fluid above the perforated platform. Similarly, an adjacent corner section of wall 11 rigidly supports an L-shaped manifold 22 having a chamber and orthogonally related walls 23 and 24 extending perpendicularly with respect to wall 11. Wall 24 includes a pyramidal array of holes (not shown) which communicate with the chamber and wall 23 includes a pyramidal array of holes 25 which communicate with the chamber. The chamber of manifold 22 is coupled to a fluid pump 26, the holes of the array on wall 24 extend in a direction normal thereto, and the holes of the array 25 extend in a direction normal to wall 23. Thus, when pump 26 is on the arrays on walls 24 and 25 provide fluid jets above the perforated platform. As may be seen in FIGS. 1 and 2, walls 19 and 23 are aligned and walls 17 and 24 face each other, as a result of which a stack of sheets 50 placed on the platform or wall 11 is partially enclosed thereby. Wall 11 slidably supports an L-shaped manifold 28 having a chamber and orthogonally related walls 29 and 30 extending perpendicularly with regard to said wall 11. As with manifolds 16 and 22, the walls 29 and 30 each include a pyramidal array of holes extending normally with respect thereto and communicating with the chamber. The chamber is coupled to a pump 31 and the holes of the arrays are directed to provide fluid jets above and parallel to wall 11. Box 13 supports a bracket 40 having a horizontally disposed elongated section located in parallel with walls 17 and 24. The elongated section slidably extends through a hole 42 in a coupling 41. In addition to hole 42, coupling 41 includes a hole 43 adapted to slidably engage a rod 44 projecting from manifold 28 in a direction normal to wall 29. Holes 42 and 43 do not intersect but are orthogonally related. Therefore, manifold 28 can be translated along the wall 11 while walls 29, 17, and 24 remain in parallel and walls 30, 19 and 23 remain in parallel. Wall 11 also slidably supports an L-shaped manifold 32 having a chamber and orthogonally related walls 33 and 34 extending perpendicularly with regard to wall 11. Wall 34 includes a pyramidal array of holes (not shown) which communicate with the chamber and wall 33 includes a pyramidal array of holes 35 which also communicate with the chamber. The chamber of manifold 32 is coupled to fluid pump 36, the holes of the array on 34 extend in a direction normal thereto, and the holes of the array 35 extend in a direction normal to wall 33. As a result, when pump 36 is on the arrays on walls 33 and 34 provide fluid jets above the wall 11. As may be seen in FIGS. 2 and 3, box 13 supports a bracket 45 having a horizontally disposed elongated section located in parallel with walls 17 and 24, and said section slidably supports a coupling 46. Coupling 46 is rigidly secured to manifold 32 by a rod 47 extending in a direction normal to wall 33 and, as a result, manifold 32 may be moved relative to wall 11 in a direction parallel to walls 17 and 24. In the apparatus disclosed, parts are designed such that wall 33 is aligned with wall 17 and it should be noticed that translation along wall 11 of either or both of manifolds 28 and 32 does not change the parallel relationship between walls 17, 24, 29 and 33 or between walls 19, 23, 30 and 34.

Figure 3:
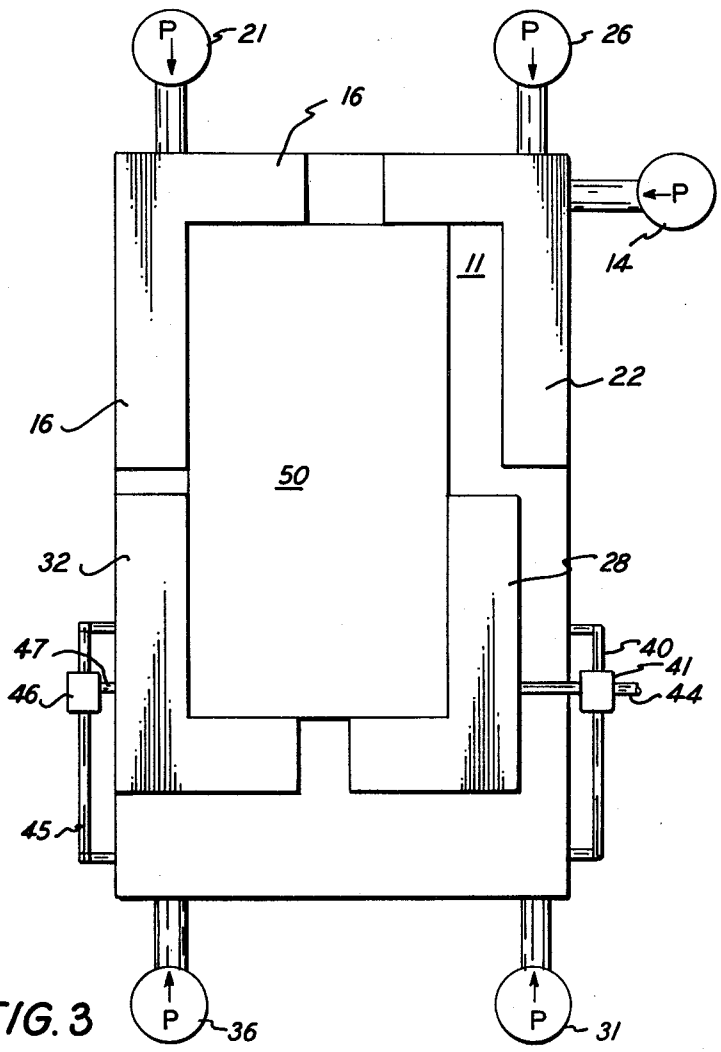
FIG. 3 is a top view of the apparatus, parts thereof having been moved to align sheets of the stack.
Figure 2:
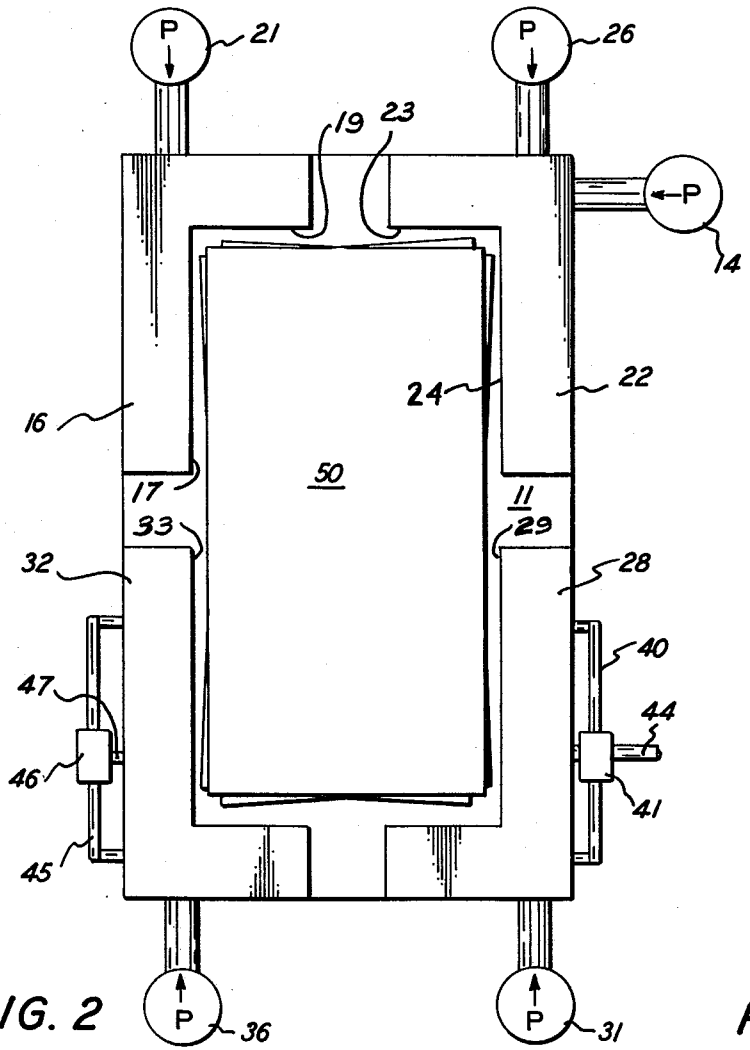
FIG. 2 is a top view of the apparatus loaded with a stack of sheets to be aligned.

Referring to FIGS. 2 and 3, when a stack of sheets 50 is placed on wall 11 and pumps 14, 21, 26, 31 and 36 are on, the stack is supported by a layer of fluid and the arrays inject fluid between sheets of the stack, whereby friction between the sheets and between the stack and wall 11 is substantially removed. Since friction between sheets is related to the weight carried by the upper of two sheets, a greater number of nozzles have been used to lubricate lower sheets of the stack, and, in fact, it is to efficiently lubricate stacked sheets that pyramidal arrays have been used in the apparatus described. Obviously, other geometric arrangements of jets may be used such that that lubrication is inversely related to the normal distance between sheets and wall 11.

Movement of manifolds 28 and 32 may be used to tamp the stack of sheets 50 against aligned walls 19 and 23 and movement of manifold 28 may be used to tamp the slack against aligned walls 17 and 33, thereby aligning, as shown in FIG. 3, sheets of the stack. It should be noticed that in the tamping process the fluid jets are brought against the stack of sheets to maximize their effectiveness.

Although in the embodiment described the box and each manifold is associated with its own pump, a commn pump may be used and the pressure it provides may be variable to provide jets having velocities required to align stacks of different heights or weights. Further, if desired, manifold 22 may be slidably coupled to the box so as to make it available for tamping.

It is to be understood that the foregoing description of apparatus embodying the subject invention has been set forth as an example thereof and is not to be construed or interpreted to limit the scope of the claims which follow and define the invention.

I claim:

1. Apparatus for aligning a stack of flimsy sheets, comprising:

(a) a perforated platform for supporting the bottom of the stack of sheets;

(b) means for driving fluid through said perforated platform to provide a fluid supporting layer between the platform and the stack of sheets on the platform;

(c) means for simultaneously injecting fluid between the sheets of the stack on the platform to reduce friction between the individual sheets, including at least two opposing L-shaped manifolds connected to a pneumatic fluid source, each said manifold including first and second orthogonally related stack edge aligning walls normal to and extending continuously from the platform adapted to engage all of the sheets in the stack, each of said walls having an array of nozzles directed to provide jets of fluid normal to said stack edge aligning walls and parallel to said platform, said arrays of nozzles extending over said walls continuously upwardly from said platform up to the top of the stack of sheets to impinge the sides of the entire stack of sheets, and the number of nozzles in each said array at a given normal distance above said platform being inversely related to the normal distance above said platform to provide fluid between the sheet in inverse proportion to the stack height; and (d) tamping means for tamping all of the sheets of the stack resting on the platform by movement of at least one said manifold parallel said platform towards the stack to bring said fluid jets in said manifold walls directly against the stack during said tamping, whereby tamping of the entire stack aligns all of its individual component sheets.

2. Apparatus as defined in claim 1, wherein said manifold is slidably supported by said platform and wherein said tamping means includes guide means for preventing substantial rotation of the manifold relative to the platform while permitting translation of the manifold relative to the platform.

* * * * *